United States Patent [19]

Lynch

[11] 4,083,623

[45] Apr. 11, 1978

[54] MINI SPRING SOCKET WITH PLASTIC BASE

[75] Inventor: James Edward Lynch, Harrisburg, Pa.

[73] Assignee: AMP Incorporated, Harrisburg, Pa.

[21] Appl. No.: 770,140

[22] Filed: Feb. 18, 1977

[51] Int. Cl.[2] ..... H01R 13/12

[52] U.S. Cl. ..... 339/258 R

[58] Field of Search ..... 339/258 R, 258 A, 258 C, 339/258 P, 258 RR

[56] References Cited

U.S. PATENT DOCUMENTS

| | | | |
|---|---|---|---|
| 3,409,860 | 11/1968 | Kirby | 339/121 |
| 3,864,004 | 2/1975 | Friend | 339/258 R |
| 3,922,057 | 11/1975 | Lemke | 339/258 P |

FOREIGN PATENT DOCUMENTS

| | | | |
|---|---|---|---|
| 657,838 | 9/1951 | United Kingdom | 339/258 P |

*Primary Examiner*—Joseph H. McGlynn
*Attorney, Agent, or Firm*—D. W. Phillion

[57] ABSTRACT

A miniature spring socket having a plastic housing containing the contact which comprises a pair of facing beam-like spring contacts which receive a terminal post therebetween. The plastic housing has slots behind the beam-like contacts to permit such beam-like contacts to be deflected back into such slots, and thereby accommodating terminal posts having large variations of diameters. The two beam-like contacts are secured to a ring-like base to which a third leg is also secured. Such third leg is bent over the rim of the housing and extends down the outside of the housing beyond the end thereof to form a tab which can be soldered to a conductive pad on the bottom side of the printed circuit board in which the mini-spring socket is installed.

15 Claims, 9 Drawing Figures

MINI SPRING SOCKET WITH PLASTIC BASE

BACKGROUND OF THE INVENTION

This invention relates generally to mini-spring sockets of the type ordinarily employed in apertures in printed circuit boards and more particularly to an improved mini-spring socket having a plastic housing which provides advantages not obtainable with prior mini-spring sockets employing metal housings.

There are available in the art many different types of mini-spring sockets which employ metal sockets with spring-like contacts contained therein. Such mini-spring sockets are ordinarily used in printed circuit boards and often form the receptacles for the terminals of dual-in-line packages (DIP) and other circuit components which are mounted upon the circuit board.

Mini-spring sockets employing metal housings are in quite common use today. They generally fall into two catagories; one being the stamped mini-spring socket and the other a machined mini-spring socket. In the case of the stamped mini-spring socket there are inherent problems of solder wicking and a possibility of short circuiting with the circuit paths on the surface of the printed circuit board in which the sockets are installed. Such short circuiting will often occur during solder reflow of the mini-spring sockets as a result of solder wicking. A further problem is the construction of a knockout bottom in the socket to enable the insertion of a terminal post completely through the socket and extending down below the surface of the printed circuit board for various purposes such as solder reflow. Efforts have been made to provide a plastic bottom in mini-spring sockets with metal housings which can be knocked out with relative ease by inserting a terminal post into and through the mini-spring socket. However such structures are fairly expensive in that they do require two materials, metal and plastic, and the piercing together of such two materials.

The mini-spring sockets employing machined housings are more efficient than stamped sockets but are relatively expensive but do not eliminate the possibility of short circuiting or solder wicking possibilities.

BRIEF STATEMENT OF THE INVENTION

It is a primary purpose of the invention to provide a mini-spring socket with a plastic housing which substantially prevents solder wicking and minimizes the possibility of electrical short circuits.

A second aim of the invention is to provide a mini-spring socket having a plastic housing which is configured to enable the spring contact contained therein to accommodate post diameters over a range in excess of a factor of two.

A third aim of the invention is to provide a mini-spring socket having a plastic housing with a knockout bottom which is integral with the socket housing and which can be knocked out simply by inserting a terminal post completely through the socket.

A fourth purpose of the invention is to provide a mini-spring socket with a plastic housing which locks the spring contact therein to prevent said spring contact from being pulled out of the housing when a terminal post or a probe is removed from the socket.

A fifth object of the invention is the improvement of mini-spring sockets generally.

In accordance with one form of the invention there is provided a mini-spring socket having a plastic housing with a spring contact means retained therein. The plastic housing preferably has a generally circular outside diameter with a flared, generally circular opening at the top thereof for insertion of the spring contact therein. A pair of oppositely positioned beveled slots are formed in the circularly flared opening of the housing and function to receive oppositely positioned and facing beam-like spring contact means of the spring contact when said beam-like spring contact means are forced apart by a terminal post inserted therebetween. The aforementioned oppositely positioned beveled slots are of sufficient depth to permit the beam-like contact means to be forced apart a sufficient distance to accommodate terminal posts being inserted therebetween having diameters extending over a range of a factor of two.

A third slot is formed in the flared opening of the housing over which a third leg of the spring contact is bent and extended downwardly along and beyond the outer side of the housing to form a tab which can be soldered to the underside of the printed circut board into which the mini-spring socket is inserted.

A feature of the invention comprises shoulders formed on the tab, or third leg, which lock under shoulders formed in the third slot extending down the outside of the plastic housing.

Another feature of the invention is the use of plastic material for the housing which minimizes the possibility of solder wicking and electrical short circuits between the mini-spring sockets and other conductive elements in the system, such as circuit paths in the printed circuit board, and further provides for an easily manufactured knockout bottom which enables a terminal post to extend completely through the mini-spring socket and out beyond the surface of a printed circuit board, or alternatively, maintains the bottom of the mini-spring socket in a sealed condition if the knocked out bottom is not knocket out.

BRIEF DESCRIPTION OF THE DRAWINGS

The above and other objets and features of the invention will be more fully understood from the following detailed description thereof when read in conjunction with the drawings in which:

FIG. 3 is a side view of the structure of FIG. 1 with a portion of the contacts shown in phantom;

DETAILED DESCRIPTION OF THE INVENTION

Figure 1:
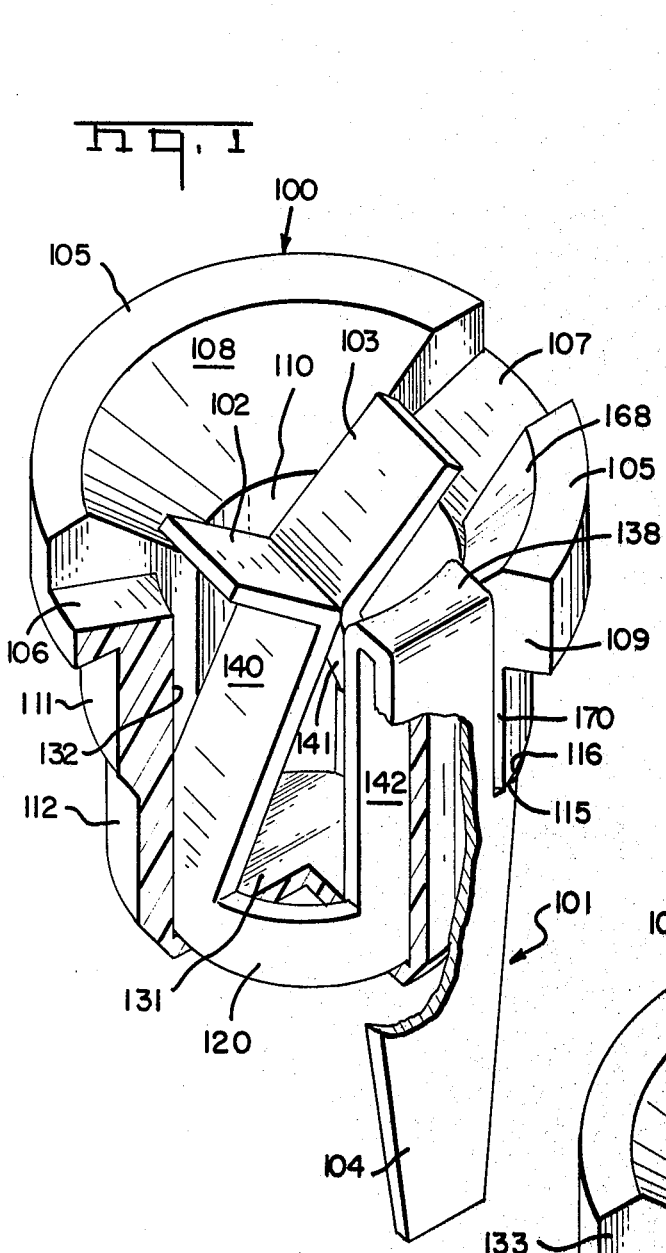
FIG. 1 is a perspective view of the mini-spring socket with portions thereof broken away to show the inner portions of the socket.

Referring now to FIG. 1 there is shown the plastic housing 100 and the metal contact 101 contained therein. The plastic housing is generally circular in configuration with a top circular surface 105 extending therearound and having three grooves 106, 107 and 109 formed therein. Further, the circular surface 105 tapers inwardly by means of a beveled surface 108 into a smaller, generally circular area 110 which, as will be seen later, is actually a circular area consisting of two perimeters of different radii.

The contact 101 consists of two beam-like members 102 and 103 which are bent to come together along a line 120 and which extend downwardly into the aperture 110 where they are secured to a ring-shaped portion 120 of the contact 101. The ring-shaped portion 120 rests on the bottom surface 131 of housing 100.

Another element 142 of contact 101 extends upwardly along the inner wall of plastic housing 100 and around the groove 109 to extend downwardly in the form of a tab 104 along the outside of plastic housing 100.

Figure 6:
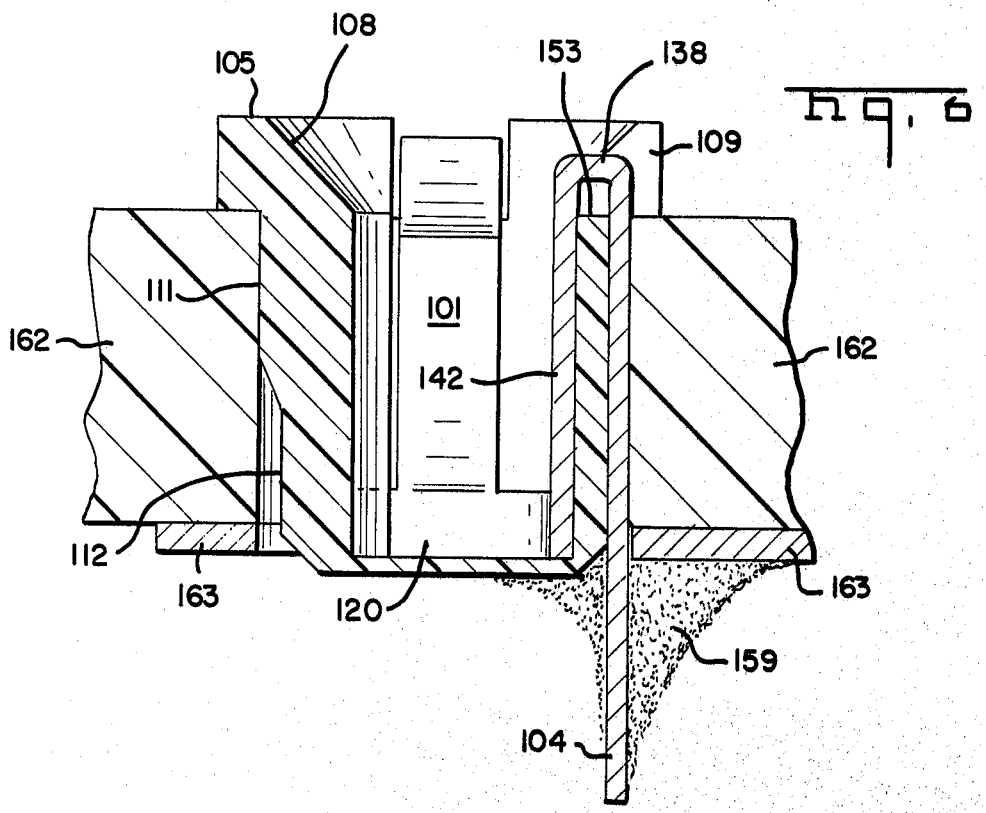
FIG. 6 is a sectional view of the plastic housing with the contacts being inserted therein taken along the plane 6—6 of FIG. 4.

As can be seen in FIGS. 3 and 6 the tab 104 can extend through an aperture in a printed circuit board 162 into which the housing 100 is mounted and connected to a conductive pad 163 on the bottom surface of the printed circuit board by solder 159 (see FIG. 3).

The slots 106 and 107 in plastic housing 100 enables the two spring-like beams 102 and 103 to separate, one from the other, upon the entrance of a terminal post 121 therebetween and to move back into said slots 106 and 107 as shown in detail in FIG. 6. More specifically, the ability of the two spring-like beams 102 and 103 to spread apart and be deflected back into the slots 106 and 107 permits the insertion of terinal posts, such as terminal post 121 (FIG. 6), having diameters which can vary over a factor greater than two.

Figure 2:
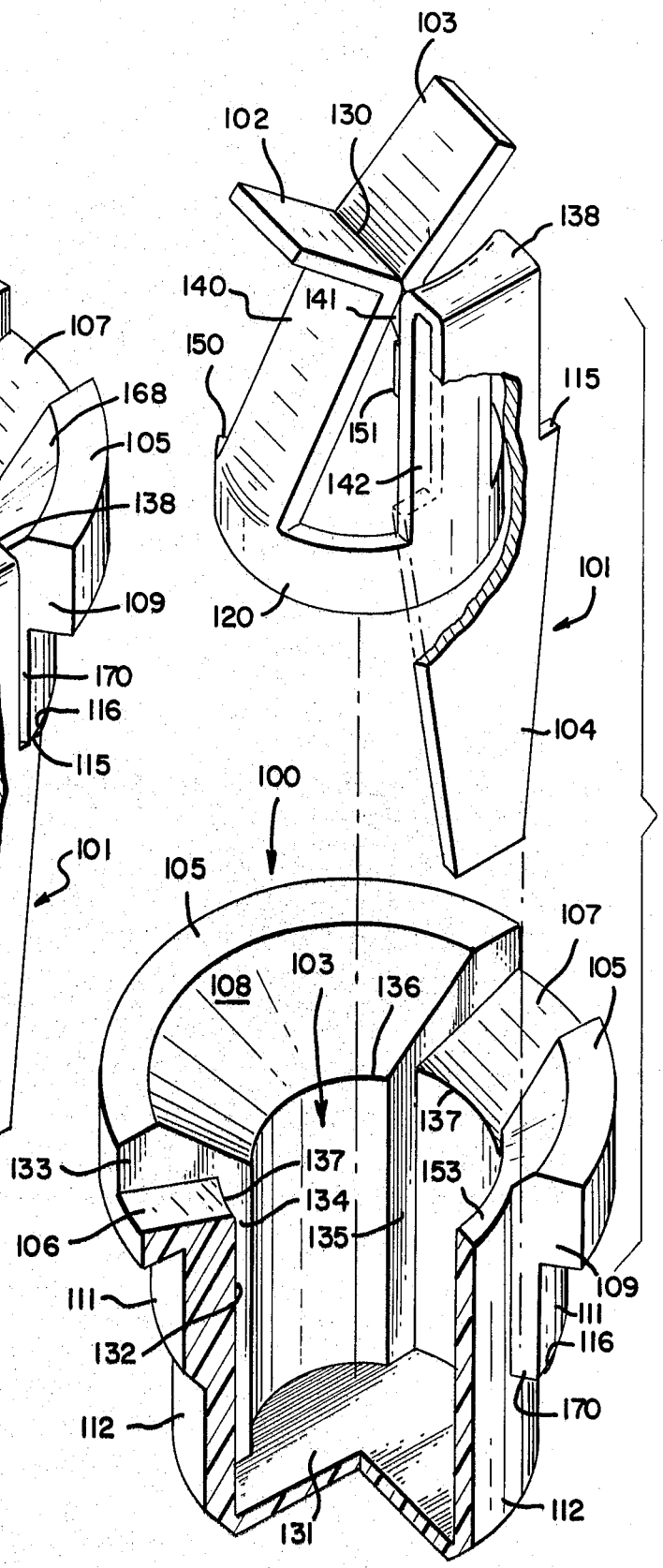
FIG. 2 is a perspective view of the socket with the contact exploded therefrom.

In FIG. 2 there is shown a view of the invention with the contact 101 removed from the plastic housing 100 but poised in a position to be inserted therein. The same reference characters employed to identify portions of the contact in the housing in FIG. 1 are also employed in FIG. 2. Additional features are shown in FIG. 2, however, that are not shown in FIG. 1.

Specifically, the different radii forming the center aperture 103 of the housing 100 is shown. The smaller radius is identified by reference character 136 and the larger radius by reference character 137, with the larger radius 137 extending all the way around the interior of the aperture 103 except for the section of radius 136 as shown in FIG. 2. The vertical ledges or shoulders 134 and 135 formed in housing 100 are due to the difference in the radii 136 and 137 and provide a means against which the ends 150 and 151 of the portion 120 of contact 101 can abut so as to fix the contacts 101 within the plastic housing 100 at such points. The tab 104 can be seen to extend from ring 120 by means of vertical element 142 which is bent over at section 138 and then extended downwardly as tab 104, fits over the edge portion 153 of the housing of FIG. 2 within the slot 109.

The shoulder 115 of the contact 101 locks under a shoulder 116 on housing 100 to secure said contact 101 within said housing 100 and prevent extraction therefrom when a terminal post is removed from contact 101 after assembly of the completed mini-spring socket in a circuit board.

Referring now to FIG. 3 there is shown a side view of the structure of FIG. 1. Similar parts of the structure of FIGS. 1 and 3 are identified by the same reference characters. In addition, the positioning of the plastic housing 100 in FIG. 3 in a printed circuit board 162 is shown. Conductive pad 163 is shown on the surface of the printed circuit board 162 and while it cannot be seen in the sectional view of FIG. 3 such conductive pad 163 is positioned close to tab 104 to contact 101. For example, in FIG. 4 conductive pad 163 can be seen to pass adjacent tab 104 of contact 101. It is to be understood that conductive pad 163 exists on the bottom surface of printed circuit board 162 as indicated in FIG. 3 and therefore is shown in phantom form in FIG. 4. The relation of the contact beams 102 and 103 as well as the tab 104 to grooves 106 and 107 and 109 can be seen clearly in FIG. 4.

Figure 4:
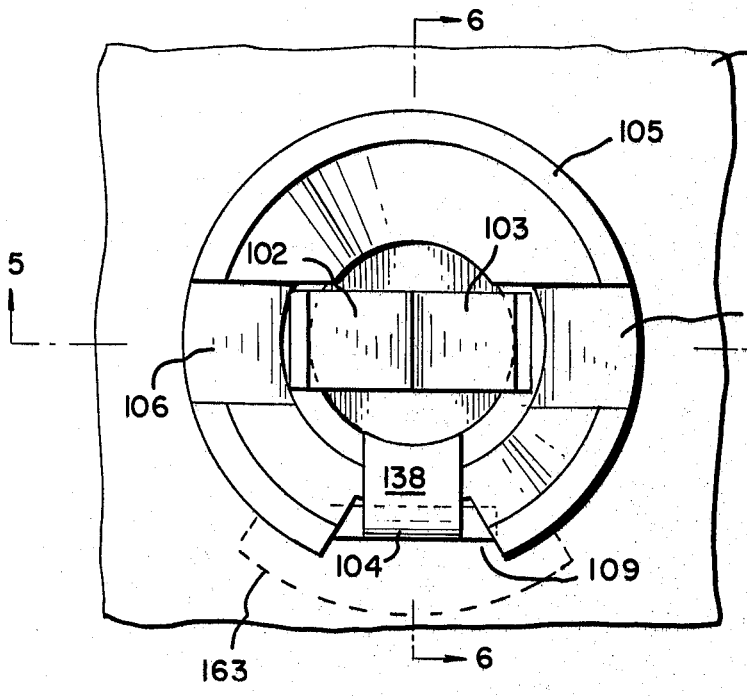
FIG. 4 is a top view of the structure of FIG. 1.
Figure 5:
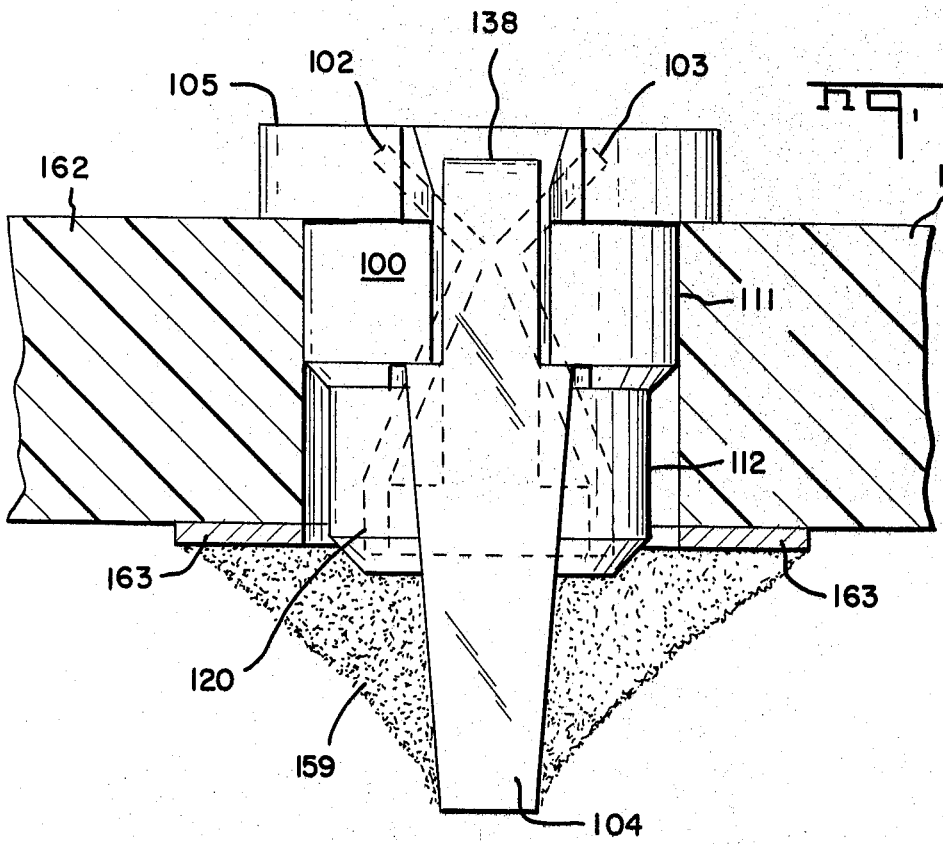
FIG. 5 is a sectional view of the plastic housing with the contacts positioned therein taken along the plane 5—5 of FIG. 4.

Referring now to FIGS. 5 and 6 there is shown sectional views of the structure of FIGS. 1 and 2 through the planes indicated as planes 5—5 and 6—6 of FIG. 4, which is a top view of the structure of FIGS. 1 and 2. One difference in the sectional view of FIG. 5 from the structure of FIG. 1 is that a terminal post 21 is shown as being inserted between contact beams 102 and 103, thereby forcing said contact beams 102 and 103 apart and towards the inner surfaces 157 and 158 of housing 100. It is evident that the limiting factor in the deflection of the contact beams 102 and 103 is the said surfaces 157 and 158. The various elements of the structure of FIG. 5 which correspond to the structural elements of FIGS. 1 through 4 are identified by the same reference characters, as are the various structural features shown in FIG. 6.

In FIG. 6 the element 142 of the contact 101 is shown extending up from the ring portion 120 of contact 101 and is then bent over the top edge 153 of the wall of housing 100. The bent-over portion 138 of the contact 101 extends downwardly to form the tab 104 which, as discussed above, can be electrically secured to a conductive pad 163 on printed circuit board 162 by solder 159.

Figure 7:
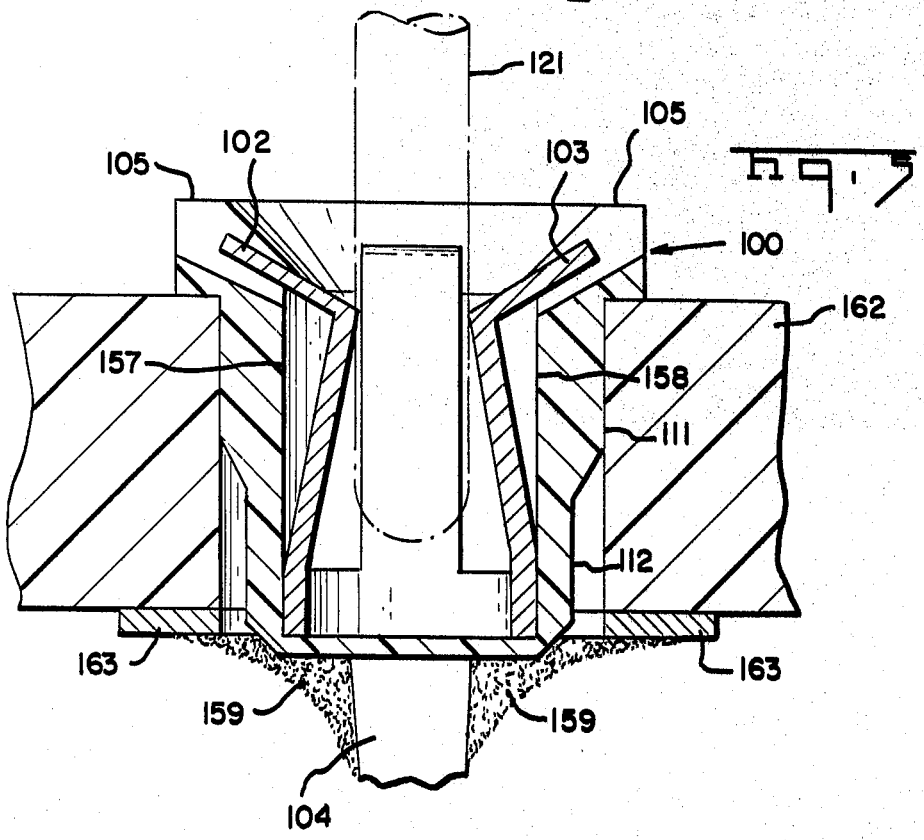
FIG. 7 is a sectional view of the structure of FIG. 4 without the contacts being inserted therein taken along the plane 5—5 of FIG. 4.
Figure 7:
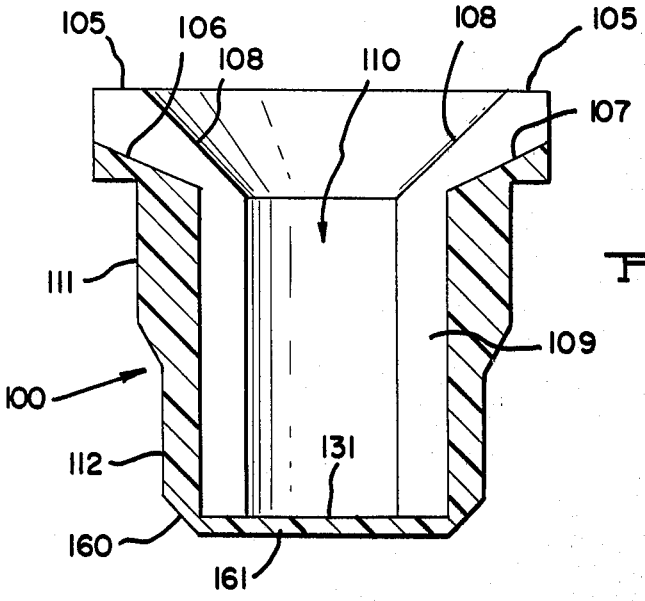
Figure 8:
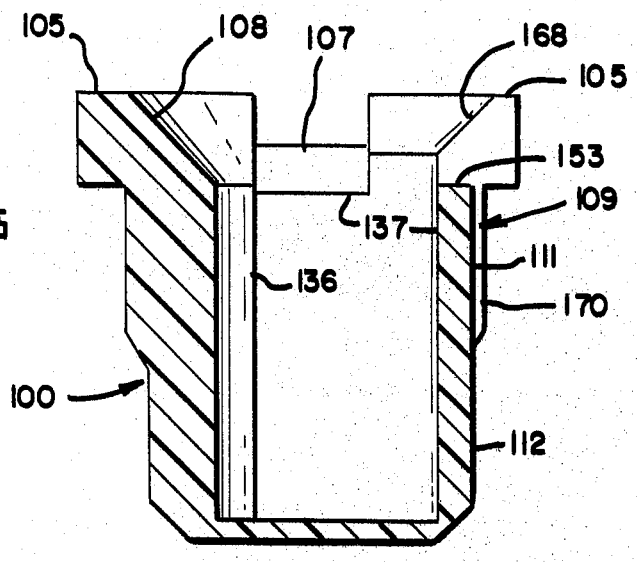
FIG. 8 is a sectional view of the structure of FIG. 4 without the contacts being inserted therein taken along the plane 6—6 of FIG. 4.
Figure 9:
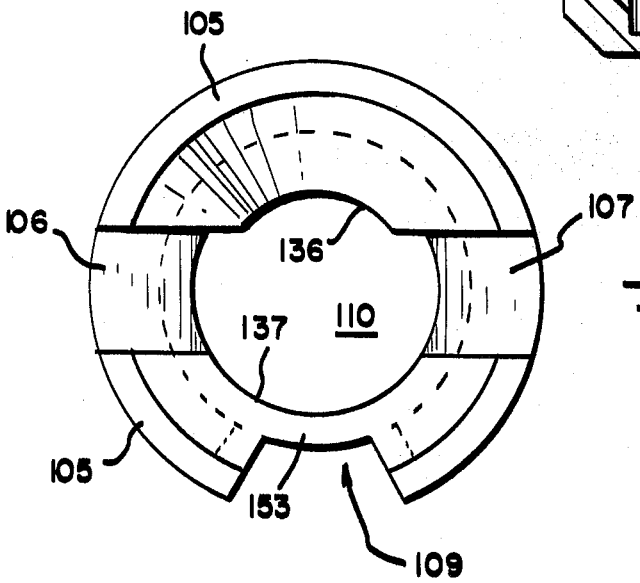
FIG. 9 is a top view of the housing of FIGS. 7 and 8 without the contacts.

Referring now to FIGS. 7, 8 and 9 there is shown respectively two sectional views of the housing and a top view of the housing without the contact being positioned therein. More specifically, in FIG. 7 there is shown a sectional view of the housing taken along the plane 5—5 of FIG. 4 without the contact 101 and shows in profile the relationship of the beveled surfaces 106, 107 and 108.

In FIG. 8, which is a sectional view of the structure of FIG. 4 taken along the plane 6—6 of FIG. 4 without the contact 101, the relationship of the beveled edge 107 and the beveled edge 168 can be seen. Looking collectively at the structures of FIGS. 1, 2 and 8 it can be see that contact 101 of FIGS. 1 and 2 folds over the upper surface 153 of wall 112 of housing 100 in between the shoulders formed by the wall portions 111, one of which shoulders is shown in FIG. 8 and identified by reference character 170.

In FIG. 9 the relationship of the smaller radius 136 and the larger radius 137 forming aperture 110 can be seen. Also shown more clearly in FIG. 7 is the relationship of the two grooves 106 and 107 which receive the two spring beams 102 and 103 of FIGS. 1 and 2 when they are deflected away from each other as a result of a terminal post being inserted thereinbetween. The slots 109 into which the tab 104 (see FIG. 2) of contact 101 fits is also more apparent in FIG. 9 and the relationship of the slot 109 to the slots 106 and 107.

It is to be understood that the forms of the invention shown and described herein are but preferred embodiments thereof and various changes can be made in the details of design of both the plastic housing and the contact without departing from the spirit or scope of the invention.

I claim:

1. A miniature spring socket comprising a plastic housing and post receiving contact means retained within said housing;

said housing being generally cylindrical in shape with a cavity formed therein and closed at one end thereof and open at the other end thereof, with a rim defining said open end and comprising:

a pair of first slots formed in said rim on opposite sides thereof and extending into said cavity; and a third slot formed in said rim between said pair of slots and extending from the cavity to the outside surface of said housing, a contact means comprising:

first and second bowed spring-like contacts secured together at first ends thereof at the closed end of said cavity and having free ends extending upwardly towards said open end of said cavity with the convex sides of said bowed spring-like contacts facing each other and with each free end being positioned to be deflected away from each other into one of said first slots; and a third element secured to the first ends of said bowed spring-like contacts and extending upwardly along the inner wall of said housing, across said third slot, and downwardly along the outside wall of said housing.

2. A mini spring socket as in claim 1 in which:

the said cavity formed within said housing is generally cylindrical in shape and is comprised of first and second sections of first and second radii with the first radius being larger than the second radius and including the said first pair of slots and the slot formed in the rim therebetween, and the second radius including that portion of the cavity between said first pair of slots which excludes said third slot.

3. A miniature spring socket as in claim 1 in which:

the configuration of the housing defining said cavity is constructed to enable deflection of said spring-like contact beams away from each other a predetermined distance to determine the maximum bending force on said spring-like contact beams.

4. A miniature spring socket as in claim 1 in which:

said housing contains first shoulder formed in said third slot extending down the outside surface thereof; and in which said third element of said post receiving contact means comprises shoulers thereon which are positioned to mate with said first shoulders on said housing when said post receiving contact means is inserted in said housing.

5. A miniature spring socket comprising:

a generally cup-shaped plastic housing with a cavity formed therein and post receiving contact means constructed to be retained within said plastic housing;

said plastic housing having a first end of said cavity closed and with a rim defining the open end of said cavity; and further comprising:

a pair of first notches formed in opposite sides of said rim and extending into said cavity; and a third notch formed in said rim between said pair of first notches and extending downwardly along the outside of said housing;

said post receiving contact means comprising:

a base portion postioned on the bottom of said housing cavity;

first and second spring-like contacts each having a concave side and a convex side and secured on said base portion and extending upwardly towards the open end of said plastic housing with the convex sides thereof facing each other and each being deflectable away from the other into one of said first notches;

a third element extending from said base portion upwardly along the inner wall of said housing, across said third notch in said housing, and downwardly in said third notch along the outside wall of said housing.

6. A miniature spring socket as in claim 5 in which:

the said cavity formed within said housing is generally cylindrical in shape and is comprised of first and second sections of first and second radii with the first radius being larger than the second radius and including the said first pair of notches and the notch formed in the rim therebetween and the second radius including that portion of the cavity between said first pair of notches which excludes said third notch.

7. A miniature spring socket as in claim 5 in which:

the configuration of said housing defining said cavity is constructed to enable deflection of said spring-like contacts away from each other a predetermined distance to determine the maximum bending force on said spring-like contacts.

8. A miniature spring socket as in claim 5 in which:

said housing contains first shoulders formed in said third notch extending down the outside surface thereof; and in which said third element of said post receiving contact means comprises shoulders thereon which are positioned to mate with said first shoulders on said housing when said post receiving contact means is inserted in said housing.

9. A spring socket comprising a plastic housing and contact means retained within said housing;

said housing comprising:

walls of a generally tubular shape with a cavity formed therein and open at a first end thereof; and a pair of first slots formed on opposite sides at the open end thereof and extending into said cavity; and a contact means comprising:

first and second bowed spring-like contacts secured together at first ends thereof within said cavity at the second end of said housing and having free ends extending upwardly towards said open end of said housing with the convex sides of said bowed spring-like contacts facing each other and with said free ends being positioned to be deflected away from each other and into one of said first slots; and a third element secured to the first ends of said bowed spring-like contacts and extending upwardly along the inner surface of the wall of said housing towards said open end, across the housing wall and downwardly along the outside surface of the wall of said housing.

10. A spring socket as in claim 9 in which:

the said cavity formed within said housing is generally cylindrical in shape and is comprised of first and second sections of first and second radii with the first radius being larger than the second radius and with the first section including the said pair of first slots and that portion of the housing wall between the pair of first slots over which the said third element extends across, and the secured section including that portion of the cavity between said pair of first slot means which excludes that portion of the housing wall over which the said third element extends across.

11. A spring socket as in claim 9 in which:

the configuration of the housing defining said cavity is constructed to enable deflection of said bowed spring-like contact away from each other a predetermined limited distance to limit the maximum bending force on said bowed spring-like contacts.

12. A spring socket comprising:

a generally cup-shaped plastic housing with an outside surface and an inside surface defining a cavity therein and contact means constructed to be retained within said cavity;

said plastic housing having a first closed end and a rim forming the opening at the other end thereof, and further comprising:

a pair of notches formed in opposite sides of said rim and extending into said cavity; and a groove formed in said outside surface between said pair of first notches and extending downwardly towards the first closed end of said housing;

said contact means comprising:

a base portion positioned forming the bottom of said cavity in said plastic housing;

first and second bowed, spring-like contacts each having a concave side and a convex side and secured on said base portion and extending upwardly towards the open end of said housing with the convex sides thereof facing each other and with each spring-like contact being positioned in front of one of said first notches; and a third element extending from said base portion upwardly along the inner surface of the wall of said housing, across the rim of said housing, and downwardly in said groove along the outside surface of the wall of said housing.

13. A spring socket as in claim 12 in which:

the said cavity formed within said housing is generally cylindrical in shape and and is comprised of first and second sections of first and second radii with the first radius being larger than the second radius and with the first section including the said first pair of notches and the groove formed in the housing therebetween and the second section including that portion of the cavity between said first pair of notches which excludes said groove.

14. A spring circuit as in claim 12 in which:

the configuration of the housing defining said cavity is constructed to enable deflection of said spring-like contacts away from each other a predetermined limited distance to limit the maximum bending force on said spring-like contacts.

15. A spring socket as in claim 12 in which:

said housing contains first shoulders formed in said groove extending down the outside surface thereof; and in which said third element of said contact means comprises shoulders thereon which are positioned to mate with said first shoulders on said housing when said contact means is inserted in said housing.

* * * * *